US005171005A

United States Patent [19]

Manley et al.

[11] Patent Number: 5,171,005

[45] Date of Patent: Dec. 15, 1992

[54] NEWSPAPER HANDLING METHOD AND APPARATUS WITH MISFEED INHIBITING CONTROL

[75] Inventors: John A. Manley, Vandalia; Aaron J. Belvo, Miamisburg; Todd C. Platt, Centerville; Andrew D. Bruce, Troy; Peter A. Wolf, Piqua, all of Ohio

[73] Assignee: TA Triumph-Adler AG, Nürnberg, Fed. Rep. of Germany

[21] Appl. No.: 739,669

[22] Filed: Aug. 2, 1991

Related U.S. Application Data

[63] Continuation-in-part of Ser. No. 662,355, Feb. 28, 1991.

[51] Int. Cl.[5] ..... B41F 13/54; B65H 5/30; B65H 43/02

[52] U.S. Cl. ..... 270/1.1; 270/55; 270/56; 270/58

[58] Field of Search ..... 270/53, 54, 55, 56, 270/57, 58, 52, 1.1

[56] References Cited

U.S. PATENT DOCUMENTS

| | | | |
|---|---|---|---|
| 4,721,296 | 1/1988 | Mowry | 270/55 |
| 4,948,109 | 8/1990 | Petersen | 270/55 |
| 4,949,949 | 8/1990 | Petersen | 270/54 |
| 5,013,019 | 5/1991 | Samuels | 270/1.1 |
| 5,029,830 | 7/1991 | Quadracci | 270/55 |
| 5,039,075 | 8/1991 | Mayer | 270/1.1 |
| 5,067,088 | 11/1991 | Schneiderhan | 270/58 |

FOREIGN PATENT DOCUMENTS

| | | | |
|---|---|---|---|
| 967668 | 5/1975 | Canada | 270/54 |

*Primary Examiner*—John T. Kwon
*Assistant Examiner*—John Ryznic
*Attorney, Agent, or Firm*—Michael J. Striker

[57] ABSTRACT

An improved newspaper handling apparatus and method enables newspapers to be formed in a sequence which is the same as the sequence in which newspapers are to be delivered to different addresses along a delivery route. Therefore, newspapers containing inserts for readers having particular characteristics can be formed and indicia corresponding to addresses along a delivery route printed on the newspapers in a sequence which is the same as the sequence in which the newspapers are delivered to the different addresses along the delivery route. During the forming of the newspapers, collating spaces are moved past hoppers from which inserts are fed. The completed newspapers are transferred from the collating spaces to a discharge conveyor in a sequence which corresponds to the sequence in which newspapers are to be delivered to different addresses along a delivery route. In the event of a misfeed of an insert for a newspaper, the transfer of newspapers from the hoppers is inhibited until a misfed section of a newspaper has been fed to the hopper at which the misfeed occurred. This enables the newspapers to be maintained in the same sequence that they are to be delivered to different addresses along a delivery route.

11 Claims, 4 Drawing Sheets

68f
60
134
130
148f
146f
70
60
38
60
56

68e
60
124
120
148e
146e
70
60
38
56

164
38
60
168
170
156
154
152
142
162
56
28

NEWSPAPER HANDLING METHOD AND APPARATUS WITH MISFEED INHIBITING CONTROL

RELATED APPLICATION

This application is a continuation-in-part of U.S. patent application Ser. No. 662,355, filed Feb. 28, 1991 by John A. Manley, Aaron J. Belvo, Todd C. Platt, Andrew D. Bruce, and Peter A. Wolf and entitled "Method of Collating Newspapers".

BACKGROUND OF THE INVENTION

This invention relates to a new and improved method and apparatus for use in handling newspapers in such a manner as to facilitate the delivery of newspapers to intended readers.

A known apparatus for use in collating identical newspapers is disclosed in U.S. Pat. No. 4,721,296. The apparatus disclosed in this patent includes a collating conveyor assembly having a jacket feed station where jackets of newspapers are sequentially fed into upwardly opening pockets. Inserts are fed into each of the pockets in turn at a plurality of insert feed stations. Thus, as a pocket moves through each of the feed stations in turn, an insert is fed into the jacket at each of the feed stations Therefore, the completed newspapers include a jacket and an insert from each of the insert feed stations.

A similar apparatus for use in collating identical newspapers is disclosed in U.S. Pat. No. 3,825,246. The apparatus disclosed in this patent is operable to compensate for the misfeed of an insert to a jacket of a newspaper during forming of the newspaper. Thus, if a feed station in this known apparatus fails to feed an insert to a pocket as the pocket moves through the feed station, the downstream feed stations are prevented from feeding inserts to the pocket to which the misfeed occurred. The newspaper jacket and any inserts in the pocket to which the misfeed occurred are not delivered at a delivery station but are again moved through the various feed stations. The feeding of inserts to the pockets to which the misfeed occurred is re-initiated with the feeding of the missed insert.

All of the newspapers formed with the apparatus disclosed in the aforementioned patents contain the same inserts. Therefore, any one of the newspapers can be delivered to any desired reader. This results in articles, advertising material and other printed matter being disseminated to all readers even though these materials will be of substantial interest to only some of the readers. If a newspaper is formed to contain materials which vary as a function of characteristics of the readers and indicia identifying the readers is printed on the newspapers, in the manner disclosed in the aforementioned application Ser. No. 662,355, filed Feb. 28, 1991 and of which this application is a continuation-in-part, provision must be made to deliver the newspapers to the intended readers along the delivery route.

SUMMARY OF THE INVENTION

The present invention relates to a method and apparatus for handling newspapers in such a manner as to facilitate the delivery of newspapers to intended readers along a delivery route. This is accomplished by printing indicia corresponding to addresses along the delivery route on portions of the newspapers in a printing sequence which is the same as the delivery sequence.

After being formed, the newspapers are bundled in a sequence which corresponds to the sequence in which the newspapers are to be delivered to different addresses along the delivery route. Therefore, it is relatively easy to deliver each of the newspapers in turn to the intended address along the delivery route.

During the forming of the newspapers, inserts or sections of the newspapers are sequentially fed from hoppers to collating spaces or pockets. In the event of a misfeed of an insert to a collating space the transfer of newspapers from the collating spaces is inhibited at least until a misfed insert is fed to the collating space at which the misfeed occurred. By inhibiting the transfer of newspapers at least until the misfed insert has been fed to a collating space, the sequence in which the newspapers are formed and delivered is maintained even though there is a misfeed during the forming of one of the newspapers.

During the forming of the newspapers, different inserts for readers having different characteristics are inserted into the newspapers. The intended readers are identified by indicia printed on the newspapers. The newspapers are maintained in a sequence which corresponds to the sequence in which they are delivered to different addresses along a delivery route, even though a misfeed may occur during the forming of a newspaper. Therefore, the delivery of the newspapers to the intended readers at different addresses along the delivery route is facilitated.

BRIEF DESCRIPTION OF THE DRAWINGS

The foregoing and other features of the invention will become more apparent upon a consideration of the following description taken in connection with the accompanying drawings, wherein.

Figures 8, 9, 10:
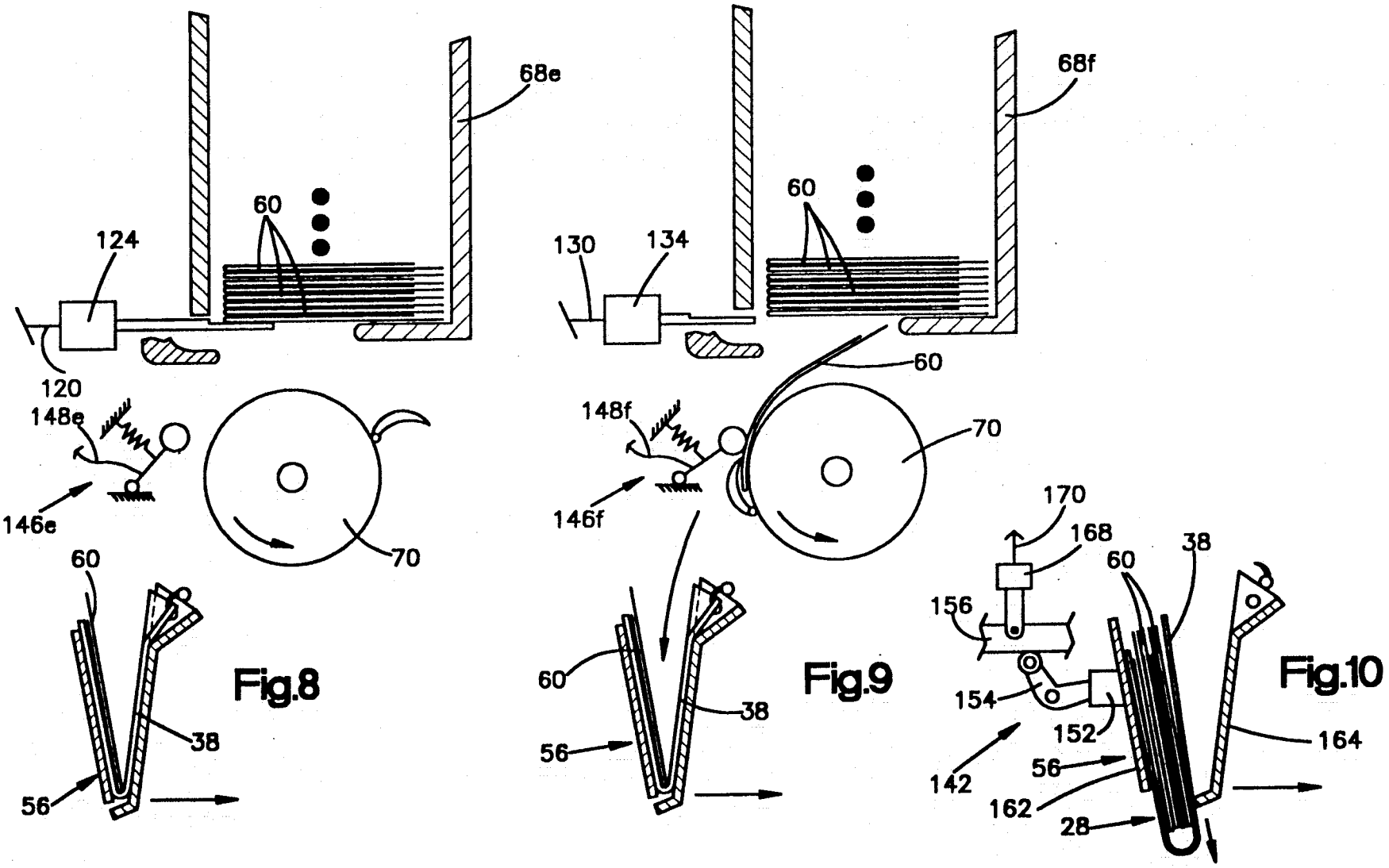
FIG. 8 is a schematic illustration, generally similar to FIG. 7, illustrating the manner in which the feeding of an insert at an insert feed station in the apparatus of FIGS. 1–4 is inhibited.
FIG. 9 is a schematic illustration depicting the enabling of the feeding of an insert to the jacket of FIG. 8 after the jacket has been moved to another insert feed station.

FIG. 10 is a schematic illustration depicting the manner in which a pocket is opened to deliver completed newspaper and illustrating the relationship between the pocket and a mechanism for inhibiting the opening of the pocket to prevent the transfer of a newspaper from the pocket in the event of a misfeed of an insert.

DESCRIPTION OF ONE SPECIFIC PREFERRED EMBODIMENT OF THE INVENTION

General Description

Figure 1:
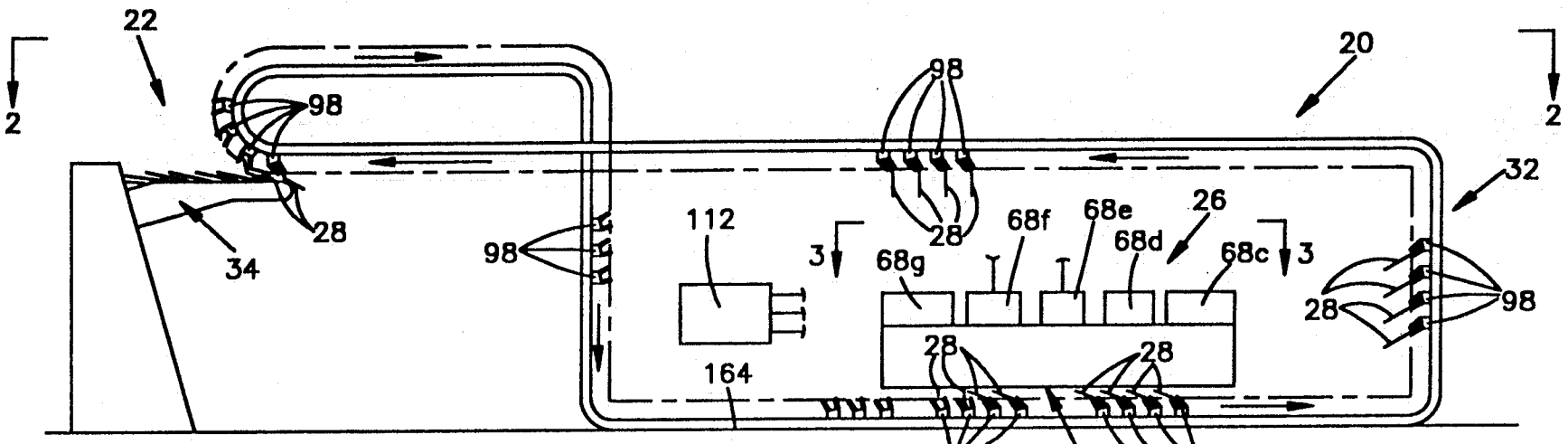
FIG. 1 is a schematic elevational view of a newspaper collating apparatus which is operated in accordance with the present invention.
Figure 2:
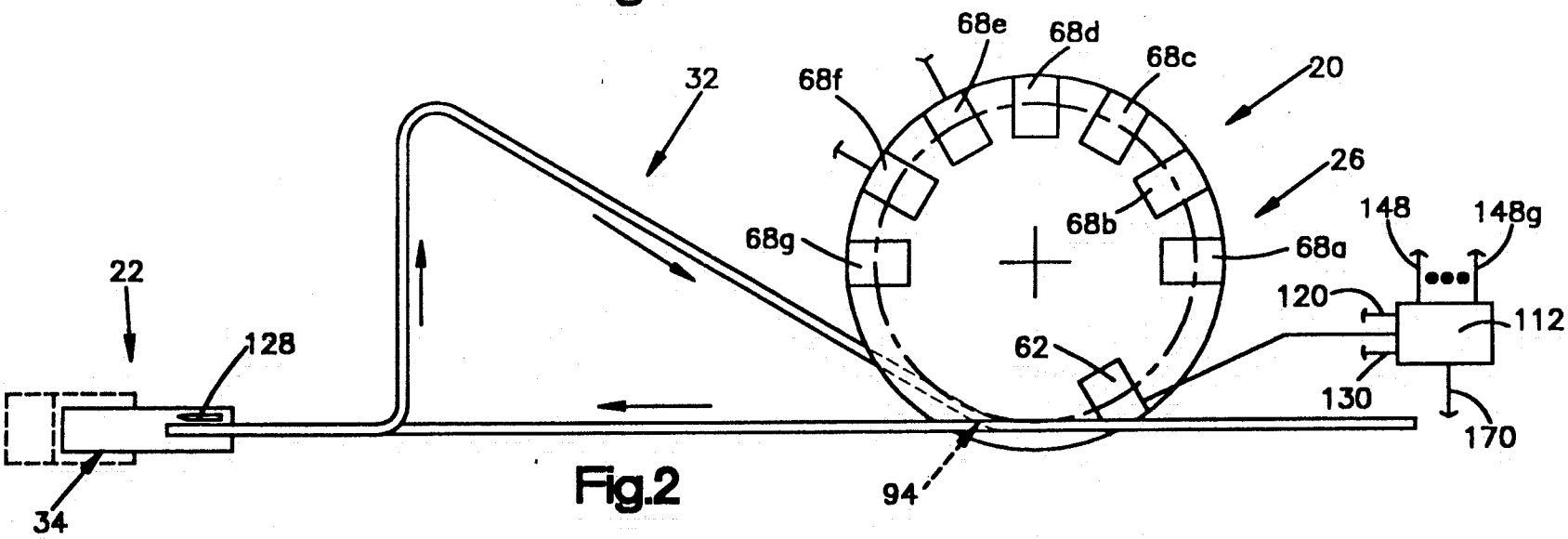
FIG. 2 is a schematic plan view, taken generally along the line 2—2 of FIG. 1, further illustrating the construction of the newspaper collating apparatus.
Figure 3:
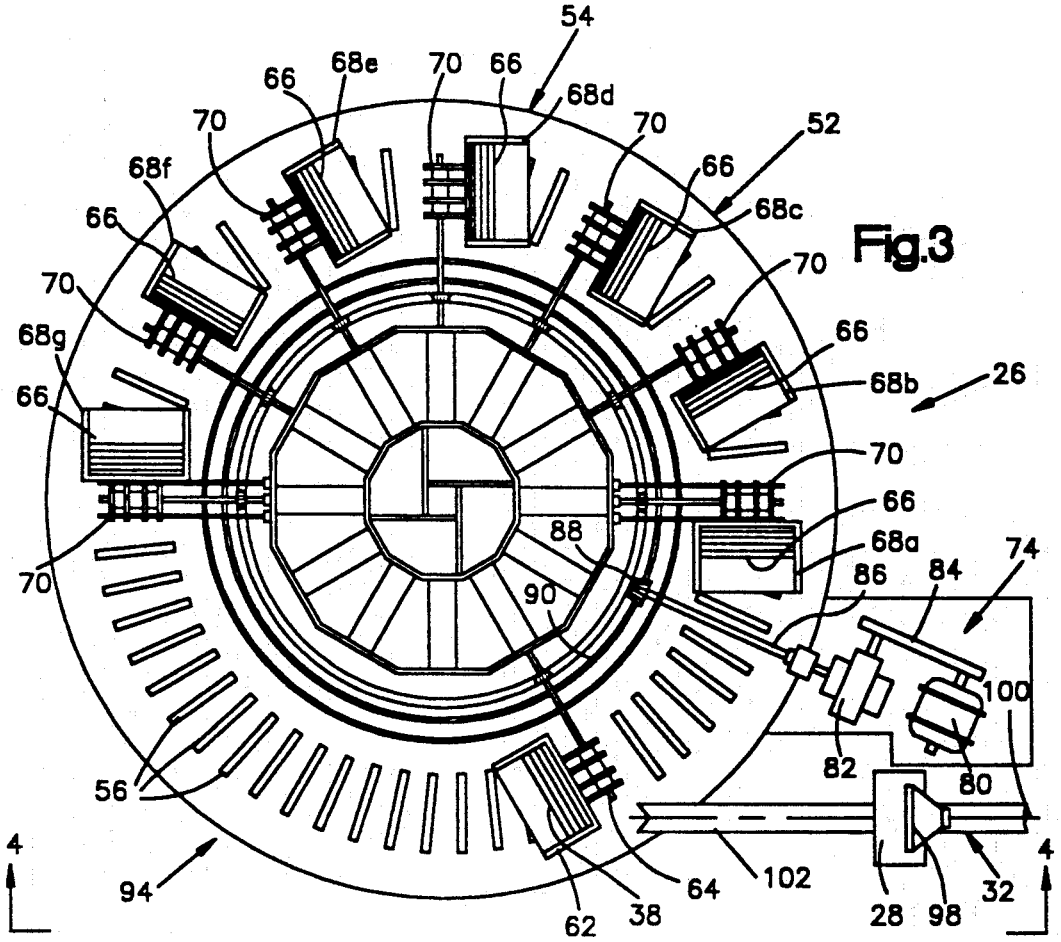
FIG. 3 is a schematic plan view, taken generally along the line 3—3 of FIG. 1, illustrating the construction of one specific inserter utilized to collate newspapers in accordance with the present invention.
Figure 4:
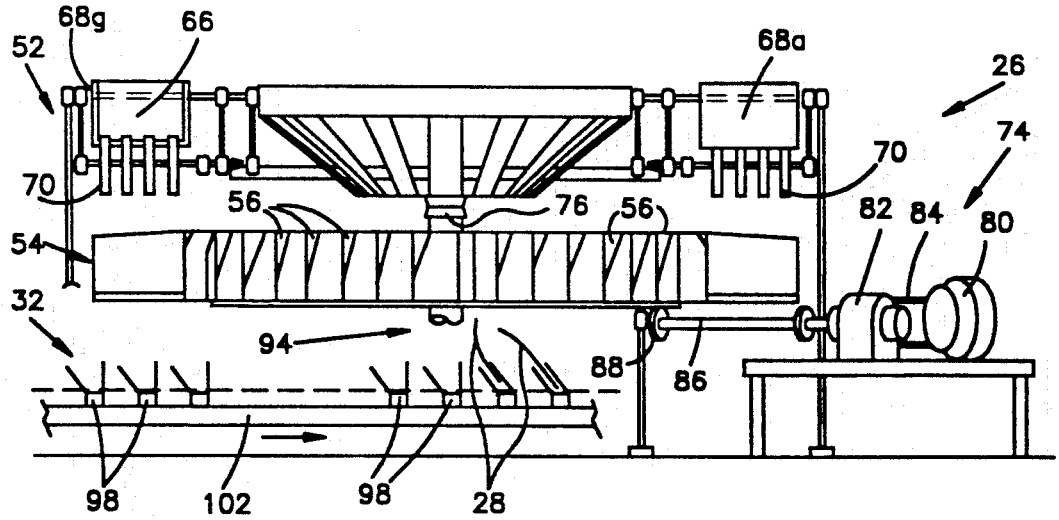
FIG. 4 is an elevational view, taken generally along the line 4—4 of FIG. 3, further illustrating the construction of the inserter.

A sheet material handling apparatus 20 (FIGS. 1 and 2) is operated in accordance with the present invention to form different newspapers for readers having different characteristics and different addresses along a delivery route. The apparatus 20 transports the newspapers to a receiving station 22 in a sequence which is the same as the sequence in which the newspapers are to be delivered. The sheet material handling apparatus 20 includes a collating conveyor assembly 26 (FIGS. 3 and 4) which is operable to form newspapers 28 (FIGS. 1 and 4).

A gripper or delivery conveyor assembly 32 sequentially grips newspapers 28 formed by the collating conveyor assembly 26. The gripper conveyor assembly 32 transports the newspapers to the receiving station 22 (FIGS. 1 and 2) in the same sequence in which the newspapers are to be delivered. A receiving conveyor 34 transports the newspapers 28 to a location for further processing. Thus, receiving conveyor 34 transports the newspapers to an apparatus which forms the newspapers into bundles with the newspapers in the same sequence as in which they are to be delivered. The bundles of newspapers are transported to a location where they are opened. The newspapers are then taken by delivery persons to the reader's addresses indicated on the newspapers.

Each of the newspapers 28 has a jacket or folded outer cover section 38 (FIG. 5) into which inserts or inner sections are stuffed during operation of the collator conveyor assembly 26. The jacket 38 has a folded or closed edge portion 46 and cut or open edge portions 42. A headline side or section 44 of the jacket 38 extends between a central fold edge portion 40 and one of the cut or open edge portions 42. Similarly, a back side or section 46 extends between the central fold 40 and the other cut or open edge portion 42.

Figures 5, 6, 7:
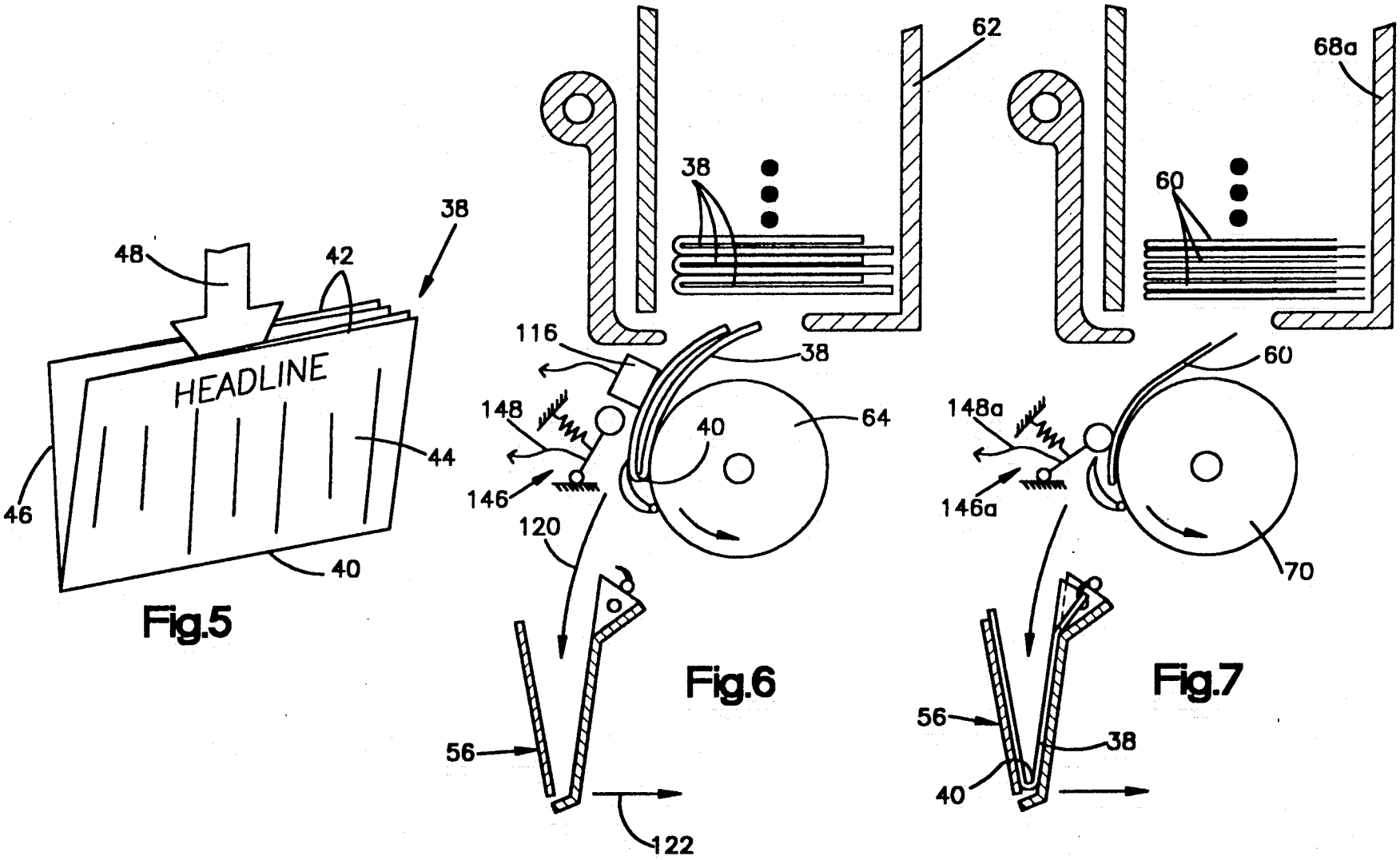
FIG. 5 is a schematic illustration of the manner in which a newspaper is collated using the apparatus of FIGS. 1–4.
FIG. 6 is a schematic illustration depicting the manner in which indicia is printed on a jacket of a newspaper as the jacket is fed from a hopper to a pocket or collating space during operation of the inserter of FIGS. 3 and 4.
FIG. 7 is a schematic illustration, generally similar to FIG. 6, illustrating the manner in which an insert is fed into the open jacket of the newspaper as the pocket moves through an insert feed station.

During operation of the collator conveyor assembly 26, the inserts for the newspapers 28 are fed into the opened jacket 38 in the manner indicated schematically by the arrow 48 in FIG. 5, to form a complete newspaper. It should be understood that the newspapers 28 could be formed in a orientation other than the upright orientation of FIG. 5.

Collator Assembly

The collator assembly 26 is a known newspaper stuffing or assembling machine. The collator conveyor assembly 26 (FIGS. 3 and 4) includes a stationary sheet material infeed mechanism 52 which is disposed directly above a movable rotor or collating conveyor 54 having a plurality of collating spaces 56. In the case of the illustrated newspaper stuffing machine, the collating spaces 56 are bottom opening pockets.

The sheet material infeed mechanism 52 includes a jacket feed station at which a jacket hopper 62 (FIG. 3) is located. A plurality of the jackets 38 are held in the hopper 62. If desired, newspaper jackets 38 could be conveyed directly to the hopper 62 from a printing press, in the manner described in U.S. Pat. Nos. 3,881,716 and 4,034,974.

The jackets 38 are sequentially fed from the stationary hopper 62 into the pockets 56 of the circular rotor 54 by a sheet feed mechanism 64. The sheet feed mechanism 64 feeds the jackets 36 into the pockets 56 with the headline sides or sections 44 of the jackets facing in the direction of movement of the pockets 56. As the rotor 54 moves the circular array of pockets 56 in a counterclockwise direction (as viewed in FIG. 3), inserts 66 are fed from hoppers **68*a* through 68*g* by sheet feed mechanisms 70**. Of course, the number of insert feed stations from which inserts are fed will vary depending upon the size of a particular newspaper.

A drive mechanism 74 rotates the rotor 54 about a center post 76 (FIG. 4) so that the open upper ends of the pockets 56 sequentially move along a continuous closed loop formed by the stationary circular array of hoppers 62 and 68 at the jacket and insert feed stations. The drive assembly 74 includes a motor 80 which is connected with a speed reducer 82 by a belt 84 (FIGS. 3 and 4). During operation of the motor 80, a drive shaft 86 rotates a pinion gear 88, disposed in meshing engagement with a ring gear 90 fixedly connected with the rotor 54. Rotation of the pinion gear 88 rotates the rotor 54 in a counterclockwise direction as viewed in FIG. 3.

As each of the pockets 56 goes through a delivery or discharge station 94, a cam control mechanism effects movement between opposite sides of the pocket to open the lower end of the pocket. As a pocket 56 opens, a newspaper 28 is delivered by being dropped from the pocket downwardly to the gripper conveyor assembly 32 (FIGS. 7–10). The manner in which the collator conveyor assembly 26 is constructed is generally the same as is disclosed in U.S. Pat. No. 2,461,573. However, it is contemplated that the collator conveyor assembly 26 could be an NP630 or NP2299 Newspaper Inserter which is commercially available from AM Graphics of Dayton, Ohio.

Although a specific collator conveyor assembly 26 having a circular construction has been disclosed, the collator conveyor assembly could have a different construction. For example, the collator conveyor assembly could have a linear construction similar to the constructions shown in U.S. Pat. Nos. 4,236,706 and 4,499,831 and 4,641,825. Although the newspapers 28 are preferably delivered by being dropped to the gripper conveyor assembly 32 from the collator assembly 26, the newspapers could be delivered in other ways if desired. For example, the newspapers could be delivered by being removed from the open upper end portions of the pockets 56. If desired, the collator conveyor assembly 26 could have a plurality of sections to enable a plurality of newspapers to be formed at a time, in the manner disclosed in U.S. Pat. Nos. 3,825,246 and 4,477,067.

Gripper Conveyor Assembly

The gripper conveyor assembly 32 includes a plurality of identical grippers 98 which are interconnected by a conveyor chain. The conveyor chain is movable along a track which has been shown schematically in FIGS. 1–4. The track extends in a continuous loop from the discharge station 94 to the receiving station 22 and back to the discharge station.

The grippers 98 are sequentially closed to engage the newspapers 28 at the discharge station 94 (FIG. 4) while the newspapers are being transported by the rotor 54 of the collator 26. The grippers 98 are then moved along the track from the discharge station 94 to the receiving station 22 (FIG. 1). At the receiving station 22, the grippers 98 are opened and the newspapers are dropped from the grippers.

Although the grippers 98 could have man different constructions, such as the construction shown in U.S. Pat. No. 4,381,056, a preferred embodiment of the gripper 98 has the same construction as disclosed in U.S. Pat. No. 4,681,213. The collator conveyor assembly 26 has the same general construction as disclosed in U.S. Pat. No. 4,721,296. The collator conveyor assembly 26 cooperates with the gripper conveyor assembly 32 in the same manner as is described in the aforementioned U.S. Pat. No. 4,721,296.

Collating Newspapers Containing Different Materials

In accordance with one of the features of the present invention, the collator conveyor assembly 26 is operated to collate newspapers 28 containing materials which vary as a function of characteristics of the readers of the newspapers. Newspapers intended for a reader having on characteristic will contain an insert which is not included in a newspaper intended for another reader which does not have that characteristic. Thus, the newspapers are, to some extent at least, customized to contain materials which vary as a function of geographic and/or demographic characteristics of the readers of the newspapers.

For example, a newspaper intended for a reader having a credit card for a particular business establishment may contain an insert which is an advertisement for that business establishment. The newspaper intended for a reader which does not have a credit card for the particular business establishment would not contain the insert which is an advertisement for that business establishment. Of course, the content of the newspaper could be varied as a function of reader characteristics other than the possession of credit cards. For example, the materials in a particular newspaper could be varied as a function of the geographic area in which the intended reader lives, or the sports enjoyed by the reader's family, etc.

The operation of the collator conveyor assembly 26 is regulated by a controller 112 (FIG. 1). In addition to the usual control functions associated with operation of the collator conveyor assembly 26, the controller 112 can either inhibit or enable the feeding of inserts from the hoppers **68*e* and 68*f* depending upon the characteristics of a reader for whom a newspaper is intended. Thus, a memory in the controller 112 contains data identifying particular characteristics of readers or subscribers for whom a newspaper is intended. The controller 112 then either enables or inhibits the feeding of an insert from the hoppers 68*e* and/or 68*f*** as a jacket section for a reader moves through the feed stations at which these hoppers are located.

In accordance with another feature of the present invention, the controller 112 enables an ink jet printer 116 (FIG. 6) to print indicia identifying an intended reader on each newspaper jacket 38 in turn. The memory in the controller 112 contains data, i.e., address information, identifying specific newspaper readers or subscribers. Thus, the data contained in the controller 112 includes the name and addresses of readers of the newspapers assembled by collator assembly 26. The data contained in the controller 112 could also include special messages appropriate to these subscribers, such as subscription lapsing or special sales promotions to be printed on the jacket 38 or inserted into the text. The data contained in the controller also includes the sequence in which newspapers are to be delivered to addresses along delivery routes.

The controller 112 could have any one of many known constructions. It is contemplated that it may be preferred to construct the controller with a Motorola 68020 microcomputer to control the operation of the printer 116 and a Motorola 68030 microcomputer to control the operation of the collator conveyor assembly 26. These microcomputers are commercially available from Motorola Communications & Electronics, Inc. of Tempe, Ariz. The ink jet printer 116 may also have many different constructions. However, it may be preferred to use a Cheshire/Videojet Model 9416 ink jet printer. This printer is commercially available from Cheshire/Videojet of Mundelein, Ill.

Each jacket 38 is fed by the sheet feed mechanism 64 with the central fold 40 downward. As a jacket 38 is fed by the sheet feed mechanism 64, the controller 112 (FIGS. 2 and 3) activates the ink jet printer 116 (FIG. 6) to print the name and address of the intended reader on the outside of the jacket. Of course, other indicia could be printed on the jacket 38 if desired.

Although the ink jet printer 116 has been shown in FIG. 6 as printing on the jacket 38 as it is fed to the pocket 56, the ink jet printer could be at other locations. Thus, it may be preferred to have the jet printer 116 print on the jacket 38 before the jacket is loaded into the hopper 62. In addition, the ink jet printer 116 could be located downstream of the collator conveyor assembly 26 if desired.

Once the jacket 38 has been fed into the pocket 56, the jacket is opened in the manner described in U.S. Pat. No. 4,477,067. Of course, other known methods of opening the jacket could be utilized if desired. Although the jackets 38 are identical, different jackets could be provided for different readers if desired.

After the jacket 38 has been opened in the pocket 56, the pocket moves beneath the hopper **68*a* at the first insert feed station. An insert 60 is fed from the hopper 68*a* into the open jacket section 38 in the manner illustrated schematically in FIG. 7. Additional inserts 60 are fed into the open jacket 38 as the pocket 56 sequentially moves through the insert feed stations at which the hoppers 68*b*, 68*c* and 68*d*** are located.

The characteristics of the intended reader for the newspaper in the pocket 56 are such that the controller 112 (FIG. 2) does not transmit a signal over a lead 120 to a feed inhibit mechanism 124. This causes the feed inhibit mechanism 124 to remain blocking the feeding of an insert 60 from the hopper **68*e*, in the manner shown schematically in FIG. 8. This is done because the characteristics of the reader for whom the newspaper in the pocket 56 is intended are such that the newspaper is not to contain an insert 60 from the hopper 68*e*. For example, the inserts 60 in the hopper 68*e* could contain advertisements for a business establishment and the intended reader for the newspaper in the pocket 56** does not have a credit card for that business establishment.

As the rotor 54 continues to rotate, the pocket 56 moves beneath the hopper **68*f* (FIG. 9) at the next adjacent insert feed station. In this case, the reader for whom the newspaper in the pocket 56 is intended has a characteristic such that he is to receive an insert from the hopper 68***f*. For example, the inserts 60 in the hopper 68*f* could contain advertisements for a second business establishment and the intended reader for the newspaper in the pocket 56 has a credit card for the second business establishment.

Therefore, the controller 112 (FIG. 2) transmits an enable signal over a lead 130 (FIG. 9) to a feed inhibit mechanism 134. This causes the feed inhibit mechanism 134 to retract and allow an insert 60 to be fed from the hopper 68*f* by the feed mechanism 70. The feed mechanism 70 feeds the insert into the open jacket 38 in the pocket 56.

The inhibit mechanism 134 is biased toward the enable or retracted condition. Therefore, the absence of an electrical potential on the lead 130 functions as an enable signal. Of course, the inhibit mechanism 134 could be biased to the extended condition if desired.

After an insert has been fed into the pocket 56 from the hopper 68*g* (FIG. 2) at the last insert feed station, the pocket 56 moves to the delivery or discharge station 94. At the discharge station 94, the pocket 56 is opened, in the manner indicated schematically in FIG. 10. A completed newspaper then falls downwardly to the open lower end of the pocket and is engaged by a gripper 98 (FIG. 1) in the gripper conveyor assembly 32. The gripper conveyor assembly 32 then transports a completed newspaper to the receiving conveyor 34 (FIG. 1).

Since the name and address of the reader for whom the newspaper 28 is intended has been printed on the jacket 38, the newspaper can be mailed or otherwise delivered to the intended reader. The newspaper will not contain an insert 60 from the hopper 68*e*. However, the characteristics of this reader are such that he should receive an insert from the hopper 68*f*. Therefore, the newspaper contains an insert 60 from the hopper 68*f*.

As the next succeeding pocket 56 proceeds to the jacket feed station beneath the hopper 62 (FIG. 6), the next jacket 38 in the hopper 62 is fed into this pocket. As this occurs, the ink jet printer 116 prints the name and address of a second reader on the jacket 38. As the pocket 56 moves beneath the hoppers 68*a*, 68*b*, 68*c* and 68*d*, inserts are fed into the jacket 38. However, since the second reader's characteristics are different than the first reader's characteristics, the controller 112 transmits an enable signal over the lead 120 to cause the inhibit assembly 124 to retract. Therefore, an insert 60 is fed from the hopper 68*e* for the second reader.

As the pocket 56 containing the newspaper for the second reader moves beneath the hopper 68*f*, the controller 112 may retract the inhibit mechanism 134 as shown in FIG. 9, or, depending upon the second reader's characteristics, extend the inhibit mechanism . Assuming that the second reader's characteristics are such that he is not to receive an insert 60 from the hopper 68*f*, the inhibit mechanism 134 is extended to block the feeding of an insert from the hopper 68*f* into the jacket 38 of the newspaper intended for the second reader.

Although the name and address of a reader is printed on a jacket 38 by the ink jet printer 116 as the jacket is fed from the hopper 62 (FIG. 6), the name and address of the reader could be printed on the jacket at other locations in the collator conveyor assembly 26. Thus, ink jet printers could be provided on each of the pockets 56 if desired. It is also contemplated that ink jet printers could be provided to print on the inserts 60 in much the same manner in which the ink jet printer 116 prints on the jackets 38. Of course, the indicia printed on the inserts could be different than the indicia printed on the jackets 38. The indicia printed on the jacket 38 could be a machine readable bar code if desired.

The printing of indicia identifying a reader on a jacket 38 of a newspaper 28 is particularly advantageous when the newspaper contains materials which are a function of one or more characteristics of a reader for whom the newspaper is intended. However, identifying indicia could be printed on the jackets 38 of identical newspapers. In addition, it should be understood that although it is preferred to print reader identifying indicia on the jackets of newspapers containing materials which vary as a function of characteristics of the readers of the newspapers, identifying indicia could be omitted or could be printed at another location in the newspaper.

Collating Newspapers in the Delivery Sequence

In accordance with another of the features of the present invention, the collator assembly 26 is operated to collate newspapers 28 in the same order or sequence that they are to be delivered to readers. Thus, a delivery sequence in which the newspapers 28 are to be delivered to different addresses along a delivery route is determined. The indicia printed on the newspaper jacket 38 by the ink jet printer 116 (FIG. 6) corresponds to addresses along the delivery route. The indicia is printed on the jackets 38 in a printing sequence which is the same as the delivery sequence in which newspapers 28 are delivered to different addresses along the delivery route.

Newspapers 28 containing inserts intended for readers with particular characteristics and having indicia identifying the addresses of these readers are formed in the same sequence as in which they are delivered along a delivery route. In addition, the newspapers 28 are transferred from the collator conveyor assembly 26 to the gripper conveyor assembly 32 in an order or sequence which is the same as the sequence in which the newspapers are delivered to different addresses along a delivery route.

The sequence in which newspapers are delivered to different addresses along a delivery route will vary with the layout of a particular delivery route. For example, the newspapers may be delivered by a delivery person who moves in a first direction along a first side of a street and then moves in the opposite direction along the second side of the street to a place across the street from where delivery of the newspapers began. The newspapers for the readers on the first side of the street are formed by the collator assembly 26 in the order in which the deliver person encounters delivery addresses on the first side of the street. The newspapers for the second side of the street are then formed by the collator assembly 26 in the order in which the delivery person encounters delivery addresses on the second side of the street. The newspapers would be formed with inserts corresponding to the characteristics of readers at each of the addresses along the first and second sides of the street.

For example, if odd numbered addresses are located on the first side of the street and increase in size or denomination in the direction of movement of the delivery person along the first side of the street, the collator assembly 26 would form the newspapers for the odd numbered addresses on the first side of the street in a sequence which corresponds to increasing address denominations. The collator would then form the newspapers for the even numbered addresses on the second side of the street in the sequence of decreasing denomination of the addresses on the second side of the street.

Indicia indicating the odd numbered addresses on the first side of the street is printed on the newspaper jackets 38 in a sequence which corresponds to the increasing address denominations. The indicia indicating the even numbered addresses on the second side of the street is then printed on the newspaper jackets 38 in a sequence which corresponds to the decreasing address denominations. The newspapers for addresses on both sides of the street would contain inserts intended for the specific readers at each of the addresses. The indicia may be printed on the jackets 38 either before or after forming the newspapers 28.

The newspapers 28 are maintained in the sequence in which they are formed by the collator assembly 26 after the newspapers leave the collator assembly. Thus, the newspapers are transferred from the collator assembly 26 to the gripper conveyor assembly 32 at the delivery station 94 in the same sequence in which the newspapers are formed by the collator assembly 26. This sequence is the same as the sequence in which the newspapers are delivered to the readers addresses along a delivery route. In addition, this sequence is the same as the sequence in which the addresses were printed on the jackets 38 of the newspapers by the ink jet printer 116.

The newspapers 28 are transferred by the gripper conveyor 32 to a receiving conveyor 34 in the same sequence as in which the newspapers were formed by the collator conveyor assembly 26. This enables the newspapers 28 to be bundled or grouped together in the sam order in which they were formed by the collator assembly 26. Bundles of newspapers could be formed by using an apparatus similar to that disclosed in U.S. Pat. No. 4,611,533. Regardless of what type of apparatus is utilized to bundle the newspapers, the newspapers are maintained in the same sequence as in which they were formed by the collator conveyor assembly 26 during the forming of the bundles of newspapers.

After the bundles of newspaper have been transported to a location near the delivery route, the bundles of newspapers are opened. The newspapers are stacked in the bundles in a sequence which is the same as the sequence in which the newspapers are to be delivered. Therefore, a delivery person carrying a stack of newspapers along a delivery route can readily remove the newspaper for each address while moving along the delivery route.

Thus, in the previous example in which newspapers are delivered to odd numbered addresses of the first side of the street and then to even numbered addresses on the second side of the street, the newspapers would be bundled in a stack with the newspapers for the odd numbered addresses on top of the newspapers for the even numbered addresses. The newspaper for the odd numbered addresses would be stacked with address denominations sequentially increasing in a downward direction from the top of the stack to the newspapers for the even numbered addresses. The newspapers for the even numbered addresses would be stacked with address denominations sequentially decreasing in a downward direction from the newspapers for the odd numbered address to the bottom of the stack.

During the forming of the newspapers 28, an insert feed mechanism 70 may fail to feed an insert 66 from one of the hoppers 68 to a jacket 36 disposed in one of the pockets 56. If the newspaper to which the misfeed occurred is not transferred to the gripper conveyor assembly 32 with the newspaper in its intended place in the sequence of newspapers transferred from the collator assembly 26, the sequence of newspapers will not be the same as the sequence of addresses to which the newspapers are to be delivered. Thus, if the pocket 56 to which an insert failed to feed is merely moved back to the hopper from which the insert failed to feed while inhibiting the feeding of additional inserts to the pocket, in the manner disclosed in U.S. Pat. No. 3,825,246, the repaired newspaper would be transferred from the pocket at the discharge station 94 out of its intended position in the sequence of newspapers 28. This could result in a newspaper intended for on reader being delivered to another reader.

In order to maintain the newspapers 28 in the same sequence as in which they are to be delivered to different addresses along a delivery route, the transfer of newspapers from the pockets 56 of the collator assembly 26 to the gripper conveyor assembly 32 is inhibited in response to the occurrence of a misfeed of an insert to one of the pockets 56. The transfer of newspapers to the gripper conveyor assembly 32 is inhibited at least until misfed insert is fed to the pocket 56 at which the misfeed previously occurred. Thus, upon the occurrence of a misfeed to a pocket 56 at the hopper **68*e* of FIG. 3, the transfer of completed newspapers 28 to the gripper conveyor assembly 32 is immediately stopped. However, the circular rotor 54** continues to turn.

During the continued rotation of the rotor 54, the transfer of newspapers 28 from the pockets 56 is inhibited. However, pockets 56 are moved relative to the hoppers **68*a* through 68*g* until the pocket 56 to which the insert misfeed occurred has returned to the hopper 68*e* from which an insert failed to feed. As the previously misfed insert is fed from the hopper 68*e* into the pocket 56 to which the misfeed occurred, the transfer of newspapers to the gripper conveyor assembly 32 at the discharge station 94 is resumed. Thus, the feeding of newspapers from the pocket 56 to the gripper conveyor assembly 32 at the discharge station 94 is inhibited for one revolution of the rotor 54**.

Inhibiting the transferring of newspapers from the pockets 56 to the gripper conveyor assembly 32 at the discharge station 94 for a complete revolution of the rotor 54 results in the collator assembly 26 returning to the same condition it was when the misfeed occurred. The misfeed is then corrected by the feeding of previously misfed insert into the pocket 56. Thus, an insert is fed from the hopper **68*e* into the pocket 56 to which the misfeed previously occurred. At the same time, the transfer of newspapers from the pockets 56 to the gripper conveyor assembly 32 at the discharge station 94 is re-established. This results in the newspapers 28 being transferred from the collator assembly 26 to the gripper conveyor assembly 32 at the discharge station 94 in the same sequence as the sequence in which newspapers are to be delivered to different addresses along a delivery route even though a misfeed occurred During rotation of the rotor 54 through a complete revolution after a misfeed occurs, the feeding of jackets 38 from the hopper 62 by the feed mechanism 64 and the feeding of inserts 66 from the hoppers 68*a* through 68*g* by the feed mechanisms 70 is also inhibited. This results in the rotor 54 moving each of the pockets 56 back to the position the pocket was in when the misfeed to one of the pockets occurred and with the sam sheet material articles in the pockets 56 as were present when the misfeed occurred. Therefore, normal operation of the collator conveyor assembly 26 can be resumed after a misfeed occurs without changing the sequence in which the newspapers are delivered to the gripper conveyor assembly 32** and without changing the intended composition of the newspapers.

The foregoing description of the operation of the collator conveyor assembly 26 results in the immediate inhibiting of the transfer of newspapers 28 from all of the pockets 56 to the gripper conveyor assembly 32 upon the occurrence of a misfeed. The inhibiting of the transfer of newspapers from all of the pockets 56 remains in effect until the rotor 54 has rotated through one complete revolution. This results in collator conveyor assembly 26 being returned to the condition which was present immediately before the misfeed occurred without delivering newspapers from the pockets and without feeding jackets 38 or inserts 66 to the pockets.

However, the collator conveyor assembly 26 could be operated in a different manner to maintain the desired newspaper delivery sequence upon the occurrence of a misfeed. For example, the pockets 56 ahead of the pocket to which a misfeed occurred contain newspapers 28 which are either properly formed or at least partially properly formed. Therefore, the formation of any incomplete newspaper could be completed and the newspapers from some or all of the pockets ahead of the pocket at which the misfeed occurred could be transferred to the gripper conveyor assembly 32 at the discharge station 94 before inhibiting the transfer of newspapers from the pockets 56.

If the newspapers in the pockets 56 ahead of a pocket to which a misfeed occurred are transferred to the gripper conveyor assembly 32 immediately after a misfed, inhibiting of the transfer of newspapers from the pockets 56 to the gripper conveyor assembly 32 would begin when the pocket 56 to which the misfeed occurred moves to the discharge station 94. The transfer of newspapers from the pockets 56 would then be inhibited for a complete revolution of the rotor 54. Thus, the pocket 56 to which the misfeed occurred would move back to the discharge station 94 before the transfer of newspapers 28 from the pockets 56 would be re-established. During rotation of the rotor 54 through a complete revolution with the transfer of newspapers from the pocket 56 inhibited, the misfed insert 66 would be fed to the pocket 56 at which the misfeed occurred at the hopper from which the insert failed to feed, that is at the hopper 68*e*. After the misfed insert has been fed at the hopper 68*e*, the feeding of inserts from the hoppers 62 and 68*a*–68*e* would be resumed. The feeding of inserts from the hoppers 68*f* and 68*g* would be resumed as the pocket 56 to which the misfeed occurred moves past these hoppers.

Whether the transfer of newspapers 28 from the pockets 56 is inhibited immediately after a misfeed occurs or after properly completed newspaper have been delivered from at least some of the pockets ahead of the pocket to which the misfeed occurred, the sequence of transfer of newspapers 28 to the gripper conveyor assembly 32 is maintained the same as the sequence in which newspapers are to be delivered to different addresses along a delivery route. Thus, in response to a misfeed of an insert 66, the rotor 54 is rotated through one complete revolution without transferring newspapers from the collator conveyor assembly 26 to the gripper conveyor assembly 32. This enables the misfed insert 66 to be fed to the pocket to which the misfeed occurred and the collator conveyor assembly returned to the starting point without disrupting the sequence in which the newspapers are transferred to the gripper conveyor assembly 32.

It is also contemplated that backup insert hoppers could be used to feed a misfed insert. If both primary and backup feeds fail, operation of the collator conveyor assembly 26 could be interrupted and a manual repair made. However, it may be preferred to continue the operation of the collator conveyor assembly 26 and compensate for a misfeed by either immediately inhibiting the feeding of inserts to all pockets 56 or by inhibiting the feeding of inserts beginning with the pocket at which a misfeed occurred.

Many different types of mechanisms could be used to inhibit the transfer of newspapers from the pockets 56 to the gripper conveyor assembly 32 in response to the occurrence of a misfeed of an insert to one of the pockets. One specific mechanism 142 for enabling the transfer of newspapers 28 from the pockets 56 during normal operation of the collator conveyor 26 and for inhibiting the transfer of a newspaper from the pockets in response to the occurrence of a misfeed is illustrated schematically in FIG. 10. Detector assemblies 146 are provided in association with the jacket feed hopper 62 and the insert feed hoppers 68*a* through 68*g* to detect the failure to feed either a jacket 38 or an insert 60.

When one of the detector assemblies 146 detects a failure to feed either a jacket 38 or insert 60, a signal is transmitted to the controller 112 over an associated lead 148. Upon receiving an input signal from a detector assembly 146 over a lead 148, the controller 112 provides a signal to the mechanism 142 to interrupt the transfer of newspapers 28 from the pockets 56 to the gripper conveyor assembly 32. The transfer of newspapers to the gripper conveyor assembly is interrupted by the mechanism 142 and controller 112 for one complete revolution of the rotor 54.

The mechanism 142 includes a latch assembly 152 which is actuated by a crank arm or cam follower plate 154. The crank arm 154 is pivoted by engagement with a cam track 156 as the pocket 56 moves into the discharge station 94. Although the mechanism 142 has been shown in FIG. 10 in association with only one pocket 56, it should be understood that there is a mechanism 142 associated with each of the pockets 56 and that the mechanism moves with the pocket during operation of the rotor 54 to rotate the pockets about the central axis of the collator assembly 26.

As each pocket 56 in turn moves into the discharge station 94, the crank arm 154 in the mechanism 142 associated with that pocket is pivoted by engagement with the cam track 156. Pivoting of the crank arm 154 actuates the latch mechanism 152 to release a back or trailing wall 162 of the hopper 56 for pivotal movement relative to a leading or front wall 164. When this occurs, the lower end portion of the pocket 56 opens and the newspaper 28 moves downwardly, under the influence of gravity, into engagement with a gripper assembly 98 of the gripper conveyor assembly 32.

If the detector assembly 146 detects a failure to feed a jacket 38 or an insert 60, a signal is provided over an associated lead 148 through 148*g* to the controller 112. In response to the signal indicating a misfeed, the controller 112 provides an inhibit signal to an actuator or solenoid 168 (FIG. 10) over a lead 170. The actuator 168 is then operated to raise the cam track 156 upwardly (as viewed in FIG. 10). The upward movement of the cam track 156 moves the cam track out of the path of travel of the crank arm 154. Therefore, the crank arm 154 is not pivoted as the pocket 56 enters the discharge station 94. This results in the pocket 56 moving through the discharge station in a closed condition.

Once the actuator 168 has been operated to raise the cam track 156, the actuator remains operated until the rotor 54 has moved through one complete revolution. Upon the completion of a revolution of rotation of the rotor 54, the inhibit signal over the lead 170 is interrupted by the controller 112. This results in the actuator 168 moving the cam track 156 back to its normal position shown in FIG. 10. When the cam track 156 is in its normal position, the crank arms 154 are again pivoted to actuate the latch assemblies 152 to open the pockets 56 and release the completed newspapers 28 for transfer to the gripper conveyor assembly 32.

The mechanism 142 may have many different constructions. For example, the mechanism 142 could have a latch assembly which is operated by a solenoid or other electrical device mounted on the pocket 56 and connected with the controller 112. This would eliminate the cam track 156. However, the specific mechanism 142 illustrated in FIG. 10 has a construction which is the same as the construction of the mechanism disclosed in U.S. Pat. No. 3,825,246.

The detector assemblies 146 through **146*g* could also have many different constructions. The detector assemblies cooperate with the feed mechanisms 64 and 70 to detect the failure to feed a jacket 38 or insert 60. The detector assemblies 146 through 146*g* may be constructed as shown in U.S. Pat. No. 4,753,430. However, it is also contemplated that the detector assemblies 146 through 146*g*** may be constructed in a manner similar to that disclosed in U.S. Pat. Nos. 4,527,793 or 4,826,149.

Conclusion

The present invention relates to a method and apparatus 20 for handling newspapers 28 in such a manner as to facilitate the delivery of newspapers to intended readers along a delivery route. This is accomplished by printing indicia corresponding to addresses along the delivery route on portions of the newspapers 28 in a printing sequence which is the same as the delivery sequence. After being formed, the newspapers 28 are bundled in a sequence which corresponds to the sequence in which the newspapers are to be delivered to different addresses along the delivery route. Therefore, it is relatively easy to deliver each of the newspapers in turn to the intended address along the delivery route.

During the forming of the newspapers, inserts or sections 60 of the newspapers 28 are sequentially fed from hoppers **68*a*–68*g* to collating spaces or pockets 56. In the event of a misfeed of an insert 60 to a collating space 56, the transfer of newspapers from the collating spaces is inhibited at least until a misfed insert is fed to the collating space at which the misfeed occurred. By inhibiting the transfer of newspapers 28 until the misfed insert 60 has been fed to a collating space 56**, the sequence in which the newspapers are formed and delivered is maintained even though there is a misfeed during the forming of one of the newspapers.

During the forming of the newspapers 28, different inserts 60 for readers having different characteristics are inserted into the newspapers. The intended readers are identified by indicia printed on the newspapers. The newspapers 28 are maintained in a sequence which corresponds to the sequence in which they are delivered to different addresses along a delivery route, even though a misfeed may occur during the forming of a newspaper. Therefore, the delivery of the newspapers 28 to the intended readers at different addresses along the delivery route is facilitated.

Having described the invention, the following is claimed:

1. An apparatus for forming newspapers, said apparatus comprising a plurality of feed stations, a discharge station, a plurality of hoppers disposed at said plurality of feed stations for holding sheet material items, a series of collating spaced sequentially movable through said plurality of feed stations and said discharge station, feed means for sequentially feeding sections of newspapers from said hoppers to said collating spaces during movement of said collating spaces through said feed stations to sequentially form newspapers at said collating spaces, conveyor means for sequentially receiving newspapers from said collating spaces during movement of said collating spaces through said discharge station, and control means for inhibiting the transfer of newspapers from a plurality of said collating spaces to said conveyor means during movement of the plurality of said collating spaces through said discharge station in response to the occurrence of a misfeed of a section of a newspaper by said feed means to one of said collating spaces at least until said feed means feeds the misfed section of a newspaper to the one collating space.

2. An apparatus as set forth in claim 1 further including means for printing on portions of the newspapers indicia corresponding to addresses along a delivery route.

3. An apparatus as set forth in claim 2 further including means for forming the newspapers into stacks with the newspapers in a sequence corresponding to the sequence of addresses along the delivery route.

4. A method of forming newspapers, said method comprising sequentially moving a series of collating spaces through a plurality of feed stations and a discharge station, feeding newspaper sections from hoppers at the feed stations to the collating spaces during movement of the collating spaces through the feed stations to sequentially form newspapers at the collating spaces, sequentially transferring newspapers from the collating spaces to a discharge conveyor during movement of the collating spaces through the discharge station, and inhibiting the transfer of newspapers from a plurality of the collating space to the discharge conveyor during movement of the plurality of collating spaces through the discharge station in response to the occurrence of a misfeed of a newspaper section to one of the collating spaces until the misfed newspaper section is fed to the one collating space.

5. A method as set forth in claim 4 further including the step of printing on newspaper sections indicia corresponding to addresses along a delivery route.

6. A method as set forth in claim 5 further including the step of forming the newspapers into bundles with the newspapers in a sequence corresponding to the sequence of addresses along the delivery route.

7. A method of handling newspapers, said method comprising the steps of sequentially forming the newspapers, said step of sequentially forming the newspapers including sequentially moving a series of collating spaces through a plurality of feed stations and a discharge station, feeding newspaper sections from hoppers at the feed stations to the collating spaced during movement of the collating spaces through the feed stations to sequentially form newspapers at the collating spaces, sequentially transferring newspapers from the collating spaces to a discharge conveyor during movement of the collating spaces through the discharge station, inhibiting the transfer of newspapers from a plurality of the collating spaces to the discharge conveyor during movement of a plurality of collating spaces through the discharge station in response to the occurrence of a misfeed of a newspaper section to one of the collating spaces, said step of inhibiting the transfer of newspapers to the discharge conveyor being performed at least until the misfed newspaper section is fed to the one collating space, determining a delivery sequence in which newspapers are to be delivered to different addresses along a delivery route, sequentially printing indicia corresponding to the addresses along the delivery route on portions of the newspapers in a printing sequence which is the same as the delivery sequence, and delivering the newspapers to the addresses printed on the newspapers in a sequence which is the same as the sequence in which the addresses were printed on the newspapers.

8. A method as set forth in claim 7 further including the step of forming the newspapers into bundles with the newspapers in a sequence corresponding to the sequence of addresses along the delivery route, said step of delivering the newspapers including the step of delivering the newspapers in the same order that the newspapers were disposed in the bundle.

9. An apparatus for forming newspapers to be delivered to different addresses along a delivery route, said apparatus comprising a plurality of hoppers for holding newspaper sections, a series of collating spaces movable past each of said hoppers in turn, means for printing on sections of the newspapers indicia corresponding to addresses along the delivery route in a sequence which is the same as the sequence in which the newspapers are to be delivered, feed means for sequentially feeding sections of newspapers from said hoppers to said collating spaces during movement of said collating spaces past said hoppers to form newspapers, conveyor means for sequentially receiving newspapers from said collating spaces and for conveying the newspapers in a sequence in which the addresses indicated by indicia printed on the newspapers are in the same sequence as the sequence in which the newspapers are to be delivered, and means for inhibiting the transfer of newspapers from a plurality of said collating spaces to said conveyor means in response to the occurrence of a misfeed of a section of a newspaper by said feed means to one of said collating spaces until said feed means fees the misfed section of a newspaper to the one collating space.

10. A method of forming newspapers which are to be delivered to different addresses along a delivery route and which contain materials which vary as a function of characteristics of the readers of the newspapers, said method comprising the steps of providing newspaper jackets, each of the jackets having a closed edge portion and an open edge portion and a central fold which extends between the open and closed end portions and divides the jacket into first and second sections, sequentially printing indicia corresponding to addresses along the delivery route on each of the jackets in turn in a printing sequence which is the same as a delivery sequence in which newspapers are to be delivered to different addresses along the delivery route, moving each of the jackets in turn through a series of newspaper insert feed stations with the central folds in the jackets downward and the first and second sections spread apart to enable newspaper inserts to be fed into the jackets, feeding a first series of inserts for newspapers for readers having a first characteristic into a first series of jackets at a first plurality of the insert feed stations as the first series of jackets move through the insert feed stations, feeding a second series of inserts for newspapers for readers having a second characteristic into a second series of jackets at a second plurality of insert feed stations as the second series of jackets moves through the insert feed stations, said step of feeding the first and second series of inserts into the first and second series of jackets including feeding newspaper inserts into the first and second series of jackets in a sequence which is the same as the delivery sequence in which newspapers are to be delivered to different addresses along the delivery route and which is independent of the characteristics of the readers of the newspaper, and sequentially transferring newspapers to a discharge conveyor and inhibiting the transfer of newspapers to the discharge conveyor in response to the occurrence of a misfeed of an insert to one of the jackets until the misfed insert is fed to the one jacket.

11. A method as set forth in claim 10 wherein said step of printing indicia corresponding to address along the delivery route on each of the jackets in turn is performed prior to performance of said step of transferring newspapers to a discharge conveyor.

* * * * *